US012560379B2

(12) United States Patent
Chishti

(10) Patent No.: US 12,560,379 B2
(45) Date of Patent: Feb. 24, 2026

(54) DYNAMIC RATE LIMITER FOR LOAD SHARING APPLICATION

(71) Applicant: SAUDI ARABIAN OIL COMPANY, Dhahran (SA)

(72) Inventor: Khurram Saeed Chishti, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 518 days.

(21) Appl. No.: 18/147,559

(22) Filed: Dec. 28, 2022

(65) Prior Publication Data

US 2024/0219115 A1 Jul. 4, 2024

(51) Int. Cl.
*F25J 3/02* (2006.01)

(52) U.S. Cl.
CPC ..... *F25J 3/0295* (2013.01); *F25J 3/0238* (2013.01); *F25J 2215/04* (2013.01); *F25J 2215/62* (2013.01); *F25J 2215/64* (2013.01); *F25J 2215/66* (2013.01); *F25J 2230/24* (2013.01); *F25J 2230/60* (2013.01); *F25J 2240/02* (2013.01); *F25J 2240/40* (2013.01); *F25J 2280/50* (2013.01)

(58) Field of Classification Search
None
See application file for complete search history.

(56) References Cited

U.S. PATENT DOCUMENTS

| | | | | |
|---|---|---|---|---|
| 3,377,018 | A | 4/1968 | Nielsen et al. | |
| 9,829,244 | B2 | 11/2017 | Mak | |
| 2018/0356151 | A1* | 12/2018 | Suraganda Narayana | G05B 23/0283 |
| 2021/0067310 | A1 | 3/2021 | Lim et al. | |
| 2022/0390170 | A1* | 12/2022 | Chishti | F25J 1/0022 |
| 2024/0219115 | A1* | 7/2024 | Chishti | G05D 7/0658 |

* cited by examiner

*Primary Examiner* — Jenna M Maroney
(74) *Attorney, Agent, or Firm* — Vorys, Sater, Seymour and Pease LLP

(57) ABSTRACT

A method for controlling flow in a Natural Gas Liquids (NGL) extraction system includes determining an operational characteristic of one or more residue gas compressors operating within the NGL extraction system and calculating a rate of closure for one or more throttle valves associated with the one or more residue gas compressors based on the operational characteristic determined. When a process upset in the NGL extraction system is detected, the one or more throttle valves are closed at the calculated rate of closure in response to detecting the process upset.

20 Claims, 5 Drawing Sheets

DYNAMIC RATE LIMITER FOR LOAD SHARING APPLICATION

FIELD OF THE DISCLOSURE

The present disclosure relates generally to systems and methods for extracting natural gas liquids (NGL) from a hydrocarbon gas stream and, more particularly, to controlling an NGL extraction process to prevent disruptions when there is an upset in a hydrocarbon gas stream flowing into a compressor.

BACKGROUND OF THE DISCLOSURE

Natural gas recovered from subterranean reservoirs is often impractical to transport from the areas where it is available to the areas where it is needed. Due to the volume of the natural gas, transportation may not be economical by ship, for example, where no pipeline is available. Cooling and liquefaction of the natural gas to form Liquefied Natural Gas (LNG) can reduce the volume of the natural gas to $1/600^{th}$ of the original volume, making it more efficient to transport aboard specially designed vessels with cryogenic storage tanks. In some instances, it may be economical to separate NGLs such as ethane, propane, butane and natural gasoline from LNG for separate transport or for use as fuel.

Processes for extracting NGLs generally include flowing an LNG stream through a series of heat exchangers, separators and turbo-expanders. Once the NGLs are extracted, a residue gas stream is often recompressed for further processing, transport or sale to customers. Throttle valves provided for each of the residue gas compressors may be closed in response to an upset in the incoming gas stream to minimize any disruption caused by the upset. Closing the throttle valves too quickly, however, could be disruptive as well. For example, the residue gas compressors could be damaged, the residue gas could be recycled rather than being delivered to customers and/or the turbo-expanders could be tripped, interrupting the extraction of NGLs altogether.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method includes (a) determining an operational characteristic of one or more residue gas compressors operating within a Natural Gas Liquids (NGL) extraction system, (b) calculating a rate of closure for one or more throttle valves associated with the one or more residue gas compressors based on the operational characteristic determined, (c) detecting a process upset in the NGL extraction system and (d) closing the one or more throttle valves at the calculated rate of closure in response to detecting the process upset.

In another embodiment, a system includes memory to store machine-readable instructions and data comprising operational data of one or more residue gas compressors operating within a Natural Gas Liquids (NGL) extraction system. One or more processors access the memory and execute the machine-readable instructions, and the machine-readable instructions cause the one or more processors to determine an operational characteristic of the one or more residue gas compressors, calculate a rate of closure for one or more throttle valves associated with the one or more residue gas compressors based on the operational characteristic determined, detect a process upset in the NGL extraction system and instruct the one or more throttle valves to close at the calculated rate of closure in response to detecting the process upset.

In another embodiment, a non-transitory computer-readable storage medium stores computer executable instructions thereon. The instructions, when executed by a processor, cause the processor to determine an operational characteristic of one or more residue gas compressors operating within a Natural Gas Liquids (NGL) extraction system, calculate a rate of closure for one or more throttle valves associated with the one or more residue gas compressors based on the operational characteristic determined, detect a process upset in the NGL extraction system and instruct the one or more throttle valves to close at the calculated rate of closure in response to detecting the process upset.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
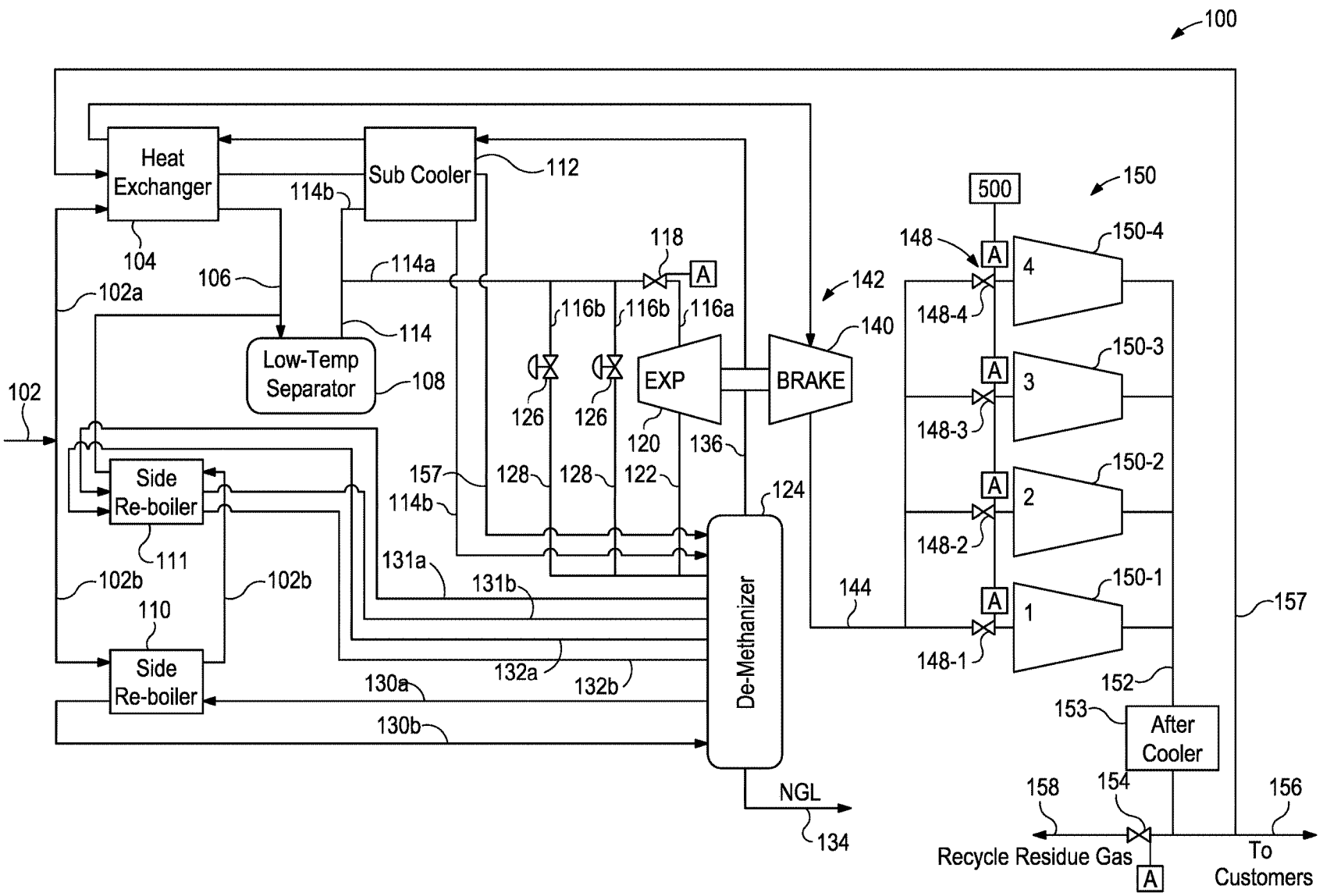
FIG. 1 is a schematic process flow diagram of a method for extracting NGLs from a hydrocarbon gas stream illustrating a residue gas stream employing four residue gas compressors, each with a throttle valve associated therewith in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to selecting and implementing a closure rate for throttle valves associated with each residue gas compressor in an NGL extraction system. The rate of closure may be based on a minimum margin detected among the residue gas compressors before an upset is detected, and applied to the throttle valves once the upset is detected. Implementing the closure rate may allow a surge controller to direct gas exiting the residue gas compressors out of the system, for example, to be delivered to customers, rather than being recycled back through the NGL extraction system.

FIG. 1 illustrates a flow control system 100 for performing NGL extraction from an inlet stream 102 of high pressure natural gas. In one example, inlet stream 102 includes crude or at least partially refined natural gas. The inlet stream 102 is split into a first portion 102*a* and second portion 102*b*. A split ratio between first portion 102*a* and second portion 102*b* of the inlet stream may be adjusted over a range of values to regulate performance of various aspects of flow control system 100. The first portion 102*a* of the inlet stream 102 enters a heat exchanger 104, where the gas may be chilled to a temperature in the range of between about −10° F. and about −40° F., in some embodiments. A stream 106 of chilled gas exits the heat exchanger 104 and is directed into a low-temperature separator 108 where any condensed liquid may be separated from the gas. The second portion 102*b* of the inlet stream 102 is directed through a bottom side re-boiler 110 and a top side re-boiler 111, where heat from the second portion 102*b* of the inlet stream 102 may be extracted for heating of the fluid streams as described below. The second portion 102*b* exits the top side re-boiler 111 and joins the stream 106 of chilled gas before entering the fluid separator 108.

A fluid stream 114 exiting the separator 108 is split into a first portion 114*a* and a second portion 114*b*. The first portion 114*a* may be directed along one of two different fluid streams 116*a* and 116*b*. The first portion 114*a* may be directed along fluid stream 116*a* when a valve 118 is open. Fluid stream 116*a* enters an expander 120 and is expanded into a stream 122, which is then directed into a de-methanizer 124. When the valve 118 is closed, the first portion 114*a* may be directed along fluid stream 116*b*, which is directed through one or more (two shown) Joule Thomson valves, or JT valves 126. The JT valves 126 expand fluid stream 116*b* into fluid streams 128. The JT valves 126 take advantage of the Joule Thomson effect, whereby rapid expansion causes the gas to cool down. Fluid streams 128 are directed into the de-methanizer 124.

The expander 120 and the JT valves 126 may operate in parallel. For example, in some embodiments, the valve 118 may be open and the JT valves may be closed in normal operation. The first portion 114*a* may thus reach the de-methanizer 124 through the expander 120. If the expander 120 is tripped or is otherwise unavailable, the valve 118 may be closed and the JT valves 126 may be opened to permit the first portion 114*a* to reach the de-methanizer 124 through the JT valves 126.

The de-methanizer 124 may be constructed as a distillation tower with mass-contacting devices (not shown) therein, which allow less volatile components of the fluid streams to settle toward a lower end of the de-methanizer 124. A liquid stream 130*a* may be drawn off from the de-methanizer 124, heated by the bottom side re-boiler 110 and returned to the de-methanizer as stream 130*b*. Similarly, fluid streams 131*a* and 132*a* may be drawn off the de-methanizer heated by the top side re-boiler 110 and returned as streams 131*b* and 132*b* respectively. Drawing fluids off from the de-methanizer 124 in this manner may reduce the overall energy required for the NGL extraction process as appreciated by those skilled in the art. In some embodiments, liquids reaching a lower end of the de-methanizer 124 may be extracted as an NGL products stream 134. A residue gas stream 136 may exit an upper end of the de-methanizer 124 for further processing.

The residue gas stream 136 may be directed though a sub-cooler 112 and the heat exchanger 104. Passing the residue gas stream 136 through the sub-cooler 112 may promote additional cooling of the second portion 114*b* of fluid stream 114 as the second portion 114 passes through the sub-cooler 112 before entering the de-methanizer 124. Passing the residue gas stream 136 through the heat exchanger 104 may promote cooling of the first portion 102*a* of the inlet stream 102 to fluid stream into 106. The residue gas stream 136 is then directed through a brake 140. As illustrated in FIG. 1, the brake 140 may be the compressor side of a turbo expander 142 formed by the expander 120 and brake 140. A discharge stream 144 exiting the brake 140 is directed to one or more throttle valves 148-1, 148-2, 148-3, 148-4 (collectively throttle valves 148) associated with one or more residue gas compressors 150-1, 150-2, 150-3, 150-4 (collectively residue gas compressors 150). As illustrated in FIG. 1, four residue gas compressors 150 (and associated throttle valves 148) are connected in parallel, but more or fewer residue gas compressors 150 may be provided without departing from the scope of the disclosure. The residue gas compressors 150 receive a share of the stream 144 according to a position of each of the associated throttle valves 148.

A fluid stream 152 exiting the residue gas compressors 150 may pass through one or more after-coolers 153 before being directed to a residue gas products stream 156. The residue gas product stream 156 may pass through a metering station (not shown) before being delivered to customers. A substream 157 may be split from the residue gas product stream 156 in some example embodiments. Substream 157 may be directed through the heat exchanger 104 and the sub-cooler 112 before reentering the de-methanizer 124.

In some instances, a recycling valve 154 is provided, which may direct all or a portion of the fluid stream 152 to a recycling stream 158. The recycling stream 158 may be recombined with inlet stream 102 or another stream within the system 100. For instance, if an upset causes an insufficient flow of fluid in stream 144 for safe operation of the residue gas compressors 150, the recycling stream 158 may be re-directed into the system 100 to supplement the fluid supplied to the residue gas compressors 150. The recycling valve 154 may remain closed in normal operations to allow a greater portion of the fluid stream 152 to be delivered to customers as residue gas products steam 156. The recycling valve 154 may be used only to protect the residue gas compressors 150 when necessary.

As appreciated by those skilled in the art, the flow control system 100 may include a variety of sensors (not shown) including pressure sensors, temperature sensors and flow rate sensors that may be monitored by a computerized flow control algorithm. The flow control system 100 may also include actuators "A" that may be responsive to instructions received by the flow control algorithm to selectively open and close valves 126, 148, 154, for example, or otherwise control the flow characteristics of the fluid within the flow control system. The actuators "A" may be communicatively coupled a computer system 500, which is operable to generate instructions for the actuators as described in greater detail below.

Figure 2:
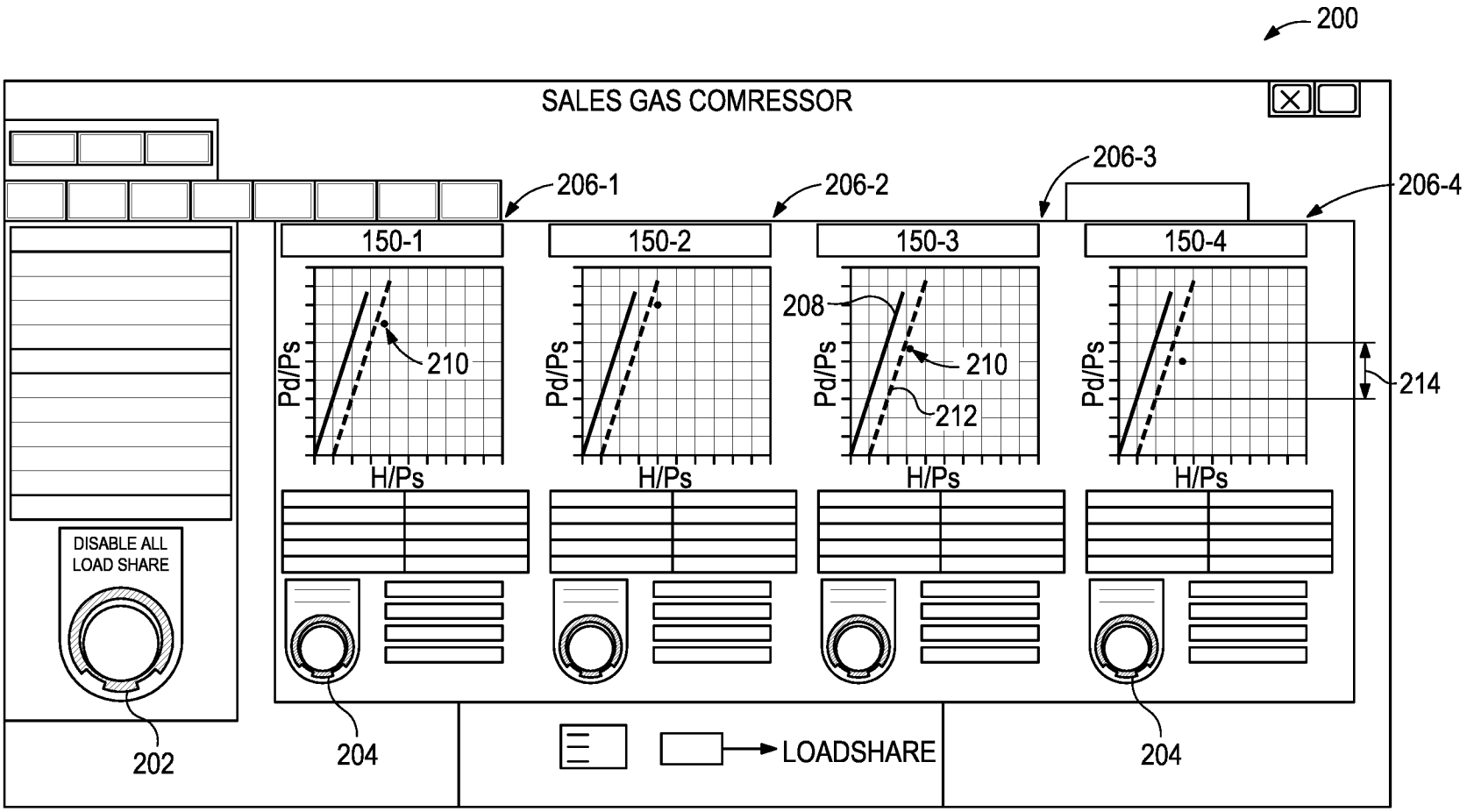
FIG. 2 is a graphical interface of an example computerized application for controlling performance characteristics of the four residue gas compressors.

Referring to FIG. 2, an example user interface 200 is illustrated for controlling a load sharing application for the residue gas compressors 150. The user interface 200 may be a component of an input device 520 (FIG. 5) of the computer system 500. The user interface 200 includes a master switch 202, which disables a computerized load sharing application of the flow control algorithm that generally distributes the flow of stream 144 (FIG. 1) among the four residue gas compressors 150-1, 150-2, 150-3 and 150-4. The master switch 202 may instantly disable the load sharing application from all four residue gas compressors 150-1, 150-2, 150-3 and 150-4 simultaneously as a group. The user interface 200 also includes controls 204, which allows individually enabling and disabling the load sharing application for the individual residue gas compressors 150-1, 150-2, 150-3 and 150-4. Additional controls and input fields are provided which may allow a user to provide inputs such as suction pressure (Ps) and a gas composition for the stream 144, and allows the control algorithm to determine variables such as compressor speed and opening positions for the throttle valves 148 (FIG. 1). The control algorithm may be operable to provide an equal throughput flow through the residue gas compressors 150, or to achieve other objectives.

The user interface 200 displays a compressor map 206-1, 206-2, 206-3, 206-4 (generally or collectively compressor maps 206) for each of the corresponding residue gas compressors 150-1, 150-2, 150-3, 150-4. The compressor maps 206 are generally graphical views illustrating operational and performance characteristics of the residue gas compressors 206. A vertical axis represents a pressure ratio (discharge pressure (Pd)/suction pressure (Ps)) and a horizontal axis represents Head (H) compensated for changes in suction pressure (H/Ps %). The horizontal axis generally represents a function of mass flow through the compressors 150. These axes are convenient for systems with changing values for suction pressure and gas composition.

A surge line 208 is illustrated on each of the compressor maps 206. To the left of the surge line 208 is a region of unstable flow, which could damage the compressors 150 as described above. Generally, the surge line 208 may represent an operational limit at which the compressor may be unable to hold back higher downstream pressures. The surge line 208 may be determined by the control algorithm from surge curves and other information provided by the compressor manufacturer.

An operating point 210 is illustrated for each of the compressors 150 that represents the current operating conditions for the compressor 150. The operating point 210 may be determined from the inlet flow and pressure variables that may be monitored by the control algorithm. Analog inputs for mass flow, suction pressure (Ps) and suction temperature may be available, for example. With these inputs, the operating point 210 for each residue gas compressor 150 may be identified on the respective compressor maps 206. The operating point 210 for a particular residue gas compressor 150-1, 150-2, 150-3 and 150-4 may be employed as a basis for calculating a rate of closure for the respective throttle valve 148-1, 148-2, 148-3 and 148-4 or for other control actions as described below.

An operating control line 212 is illustrated to the right of the surge line 208. The operating control line 212 is offset from the surge line by a safety margin 214 that may be selected according to the manufacturer's design parameters. For example, a 10% safety margin may often be selected, which represents an operational limit that will allow corrective action to be taken before an operating point 210 approaches or crosses the surge line 208. For example, if an operating point 210 reaches the operating control line 212, the control algorithm may send instructions to the recycling valve 154 (FIG. 1) to direct flow back to the inlet flow 102. Additionally or alternatively, the control algorithm may send instructions to selectively control one or more of the throttle valves 148 to prevent damage to the residue gas compressors 150.

Figure 3:
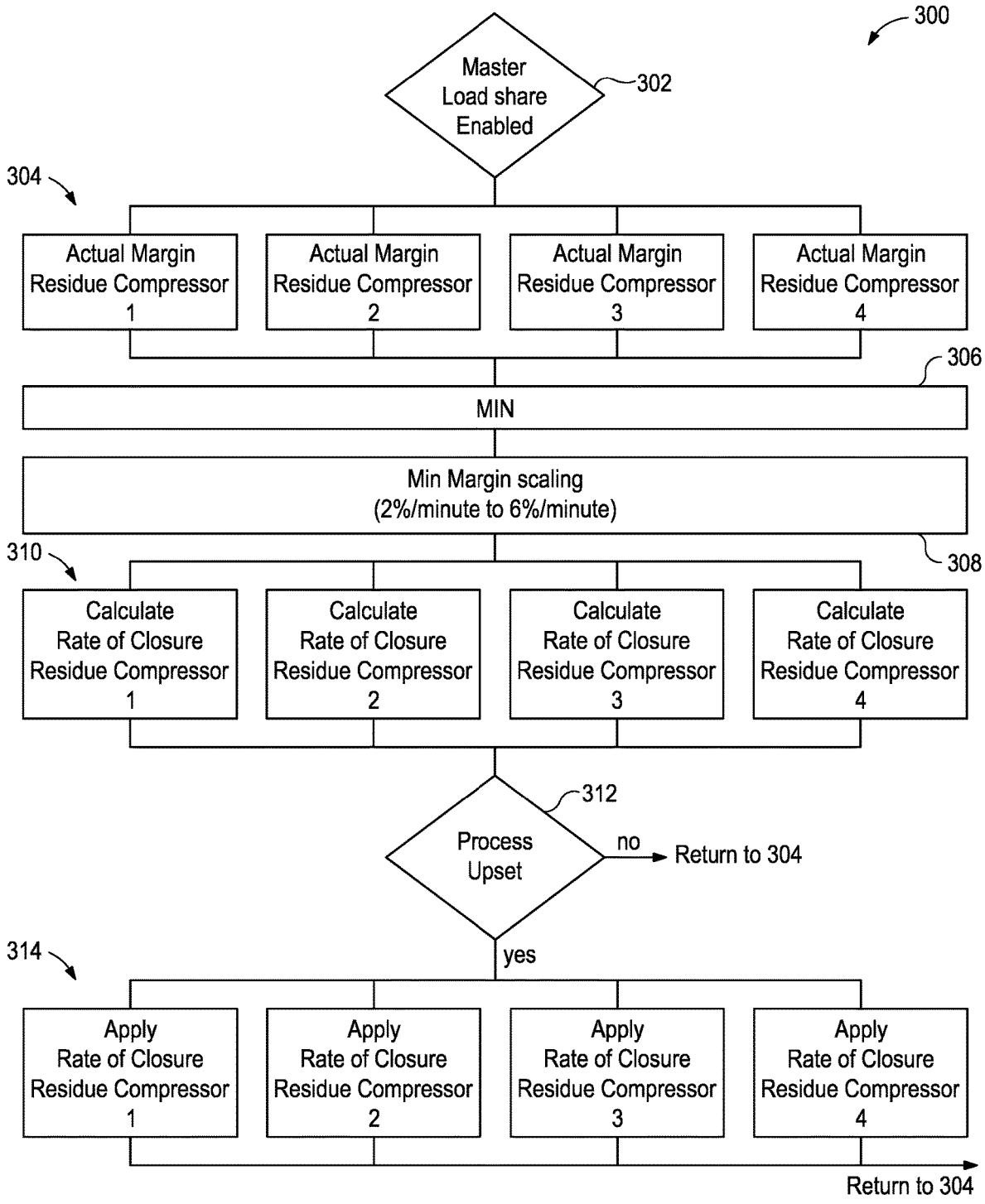
FIG. 3 is a flow chart illustrating a process for calculating and implementing a closure rate for each throttle valve.

Referring to FIG. 3, and with continued reference to FIGS. 1 and 2, an operational procedure 300 is illustrated, which may be implemented by a load sharing application controlling the operation of residue gas compressors 150. In view of the foregoing structural and functional features described above, example methods will be better appreciated with reference to FIG. 3. While, for purposes of simplicity of explanation, the example procedure 300 of FIG. 3 is shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the methods.

Initially at decision 302 it is determined whether the load sharing application is enabled. If it is not enabled, an operator may manipulate the individual controls 204 to enable the load sharing application and permit the procedure 300 to proceed.

At step 304, an actual margin for each of the compressors 150 is calculated. The actual margin is may be calculated by determining a vertical distance between the operating point 210 and the control line 212 for each of the individual residue gas compressors 150-1, 150-2, 150-3, 150-4. Since the vertical axis of the compressor maps 206 is a dimensionless ratio (Pd/Ps) or percentage, the actual margins for the compressors may also be a dimensionless ratio or percentage. Step 304 may be executed by one or more processors 501 of a computer system 500 (FIG. 5) as described in greater detail below.

To protect the residue gas compressors 150 in the event of an upset, the throttle valve 148 associated with the residue gas compressor 150 operating furthest from its control line 212 may be closed more quickly than the throttle valve 148 associated with the compressor 150 operating closest to its control line 210 without disrupting the extraction of NGLs. If the operating point 210 of a particular residue gas compressor 150 is relatively far right of the control line 212, shocks (in terms of upsets) may more readily be accommodated and acted upon quickly without compromising the protection of the residue gas compressor 150. Conversely, if the operating point 210 of a particular residue gas compressor 150 is very close to the control line 212, there may not be an opportunity for corrective action to be effected before the surge controller operates to open the recycling valve 154 to protect the compressors 150. Thus, at step 306, the actual margins for the individual residue gas compressors 150-1, 150-2, 150-3, 150-4 are compared to one another by the processor 501 (FIG. 5) for example, and the minimum of the four actual margins is identified. The residue gas compressor 150 with the minimum actual margin will be operating closest to the operating control line 212, and thus a rate of closure for the throttle valves 148 may be based on the minimum margin identified.

Once the minimum actual margin is identified, the procedure 300 may proceed to step 308 where a scaled minimum margin is determined. The minimum actual margin may be scaled with the processor 501 (FIG. 5), for example. The minimum actual margin may be scaled by any function to arrive at scaled minimum margin within a predetermined range. For example, in some embodiments, the predetermined range may be between about 2% closure per minute and about 6% closure per minute. Scaling the minimum margin to a percentage rate per minute provides a quantity related to the minimum margin that may actually be applied to the throttle valves 148. In some embodiments, the scaled minimum margin may be selected for application to each of the four throttle valves 148-1, 148-2, 148-3, 148-4, and in other example embodiments, each of the margins may be scaled by the same function that resulted in the scaled minimum margin being within the predetermined range.

Figure 5:
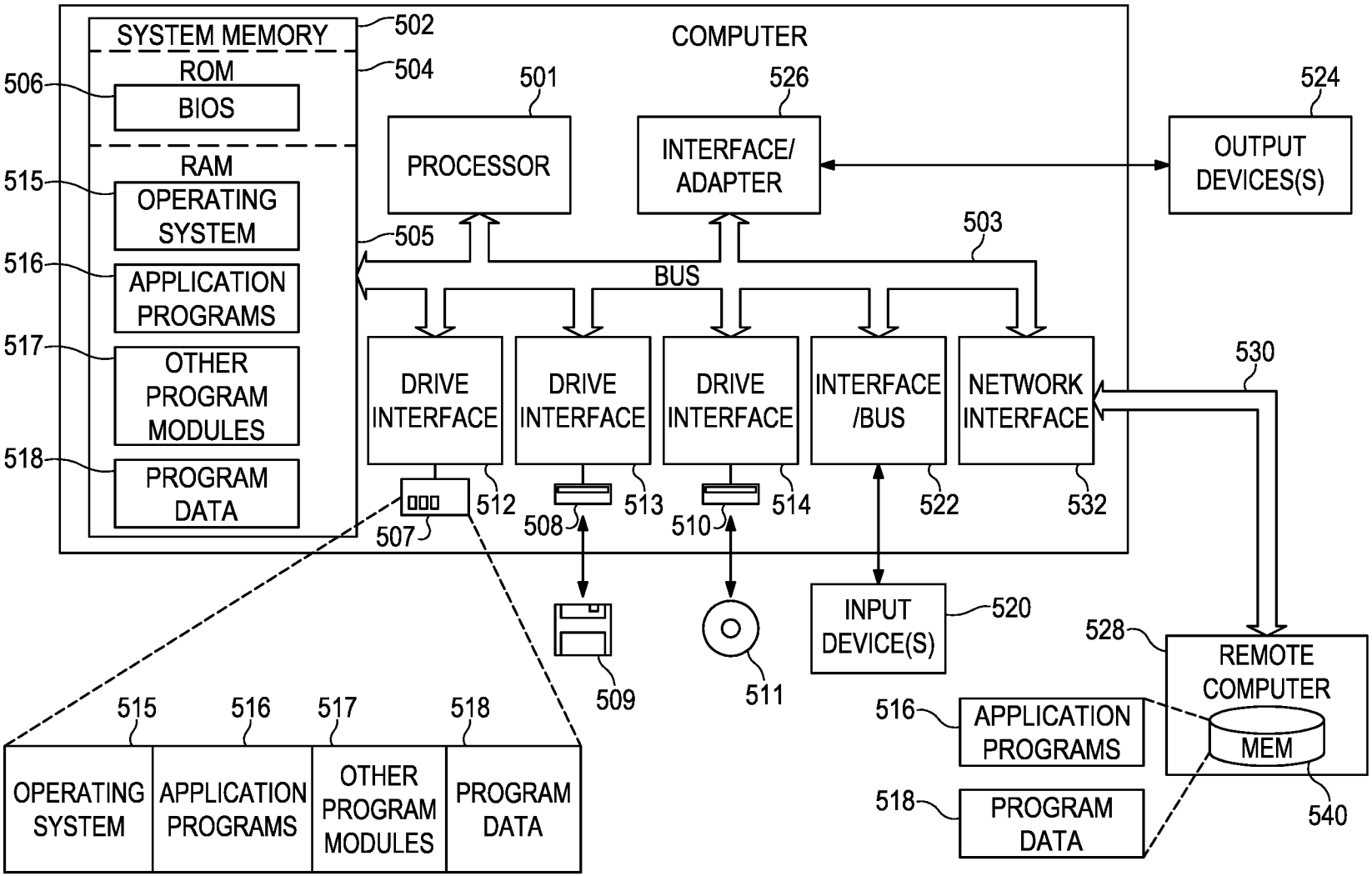
FIG. 5 is a block diagram of non-limiting example computer environment that may be employed to implement one or more procedures described herein.

Once the scaled margins are selected, an actual planned closure rate for the throttle valves 148 may be to be calculated in step 310, for example with the processor 501 (FIG. 5). The actual planned rate of closure for each of the throttle valves 148 is determined based on the existing positions of the throttle valves 148, the scaled margin or margins determined in step 308.

The procedure 300 then proceeds to decision 312 where it is determined whether a process upset has been detected. The process upset may be detected by the processor 501, for example, evaluating operational data of the NGL extraction system 100. A process upset may include, for example, an operating point 210 crossing a control line 212 for one of the compressors 150, a sudden closure of one of the JT valves 126, a loss of flow at the inlet stream 102, a trip or fault of the turbo expander 142, the detection of any other operating parameter detected to be outside a predetermined operating range, and so on. If no process upset is detected, the procedure returns to step 304 where the current operating conditions are again considered to determine the actual margins of the compressors 150. As long as no process upset is detected, the procedure 300 continues to evaluate the current operating conditions to dynamically determine a closure rate for the compressors 150 at any given moment.

If a process upset is detected at decision 312, the procedure 300 proceeds to step 314 where the planned rate of closure is applied to the throttle valves 148 associated with residue gas compressors 150. The processor 501 (FIG. 5) may provide instructions to the actuators "A" to apply the planned rate of closure to the throttle valves. The procedure 300 may then return to step 304 where the actual margins are again evaluated, and an updated rate of closure may be calculated accounting for the effect of the closure of the throttle valves. By iteratively and dynamically restricting the closure of the throttle valves 148 in this manner until the process upset is no longer detected, the residue gas compressors 150 may be unloaded gradually without tripping such that NGL extraction may be maintained even in the event of a process upset. It may be determined that the process upset has been addressed, for example when a detected pressure is within a predetermined tolerance of a predefined threshold. For example, when a header pressure detected in the discharge stream 144 exiting the brake 140 is less than 5 PSIG from a pressure threshold input using the user interface 200. Limiting the rate of closure of the throttle valves 148 based on an operating condition of the compressors 150 in this manner not only protects the compressors 150 themselves, but also avoids wear and tear on the throttle valves 148 that may occur when more rapidly closing the throttle valves 148.

Figure 4A:
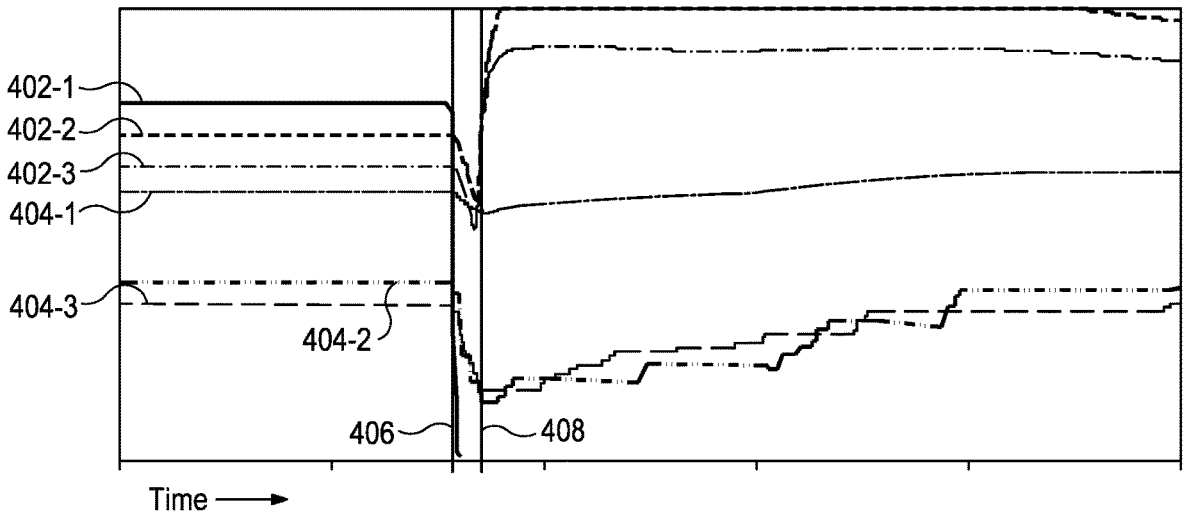
FIGS. 4A and 4B are graphical views of residue gas margin trends detected respectively before and after implementing the process illustrated in FIG. 2.
Figure 4B:
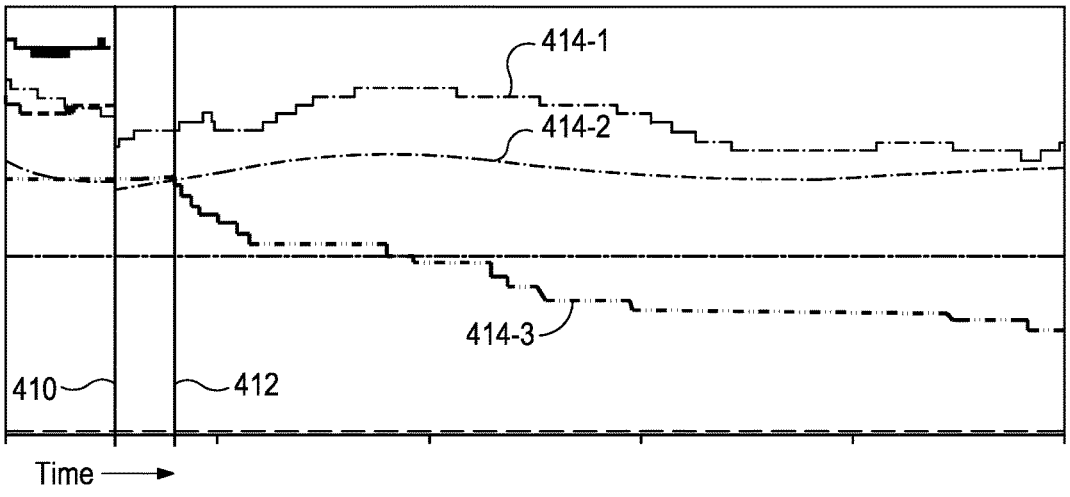

Referring to FIGS. 4A and 4B, performance characteristics of the compressors 150 are illustrated in two example scenarios. FIG. 4A represents the margins of the compressors 150 over time when the throttle valves 148 are closed quickly in the event of a process upset. Similarly, FIG. 4B represents the margins of the compressors 150 when the closure rate of the throttle valves 148 are limited in accordance with aspects of the disclosure.

In FIG. 4A, curves 402-1, 402-2 and 402-3 represent the margins of three corresponding residue gas compressors 150-1, 150-2 and 150-3. Only three of the four compressors 150 were operational in this example. Curves 404-1, 404-2 and 404-3 represent the positions of the corresponding throttle valves 148-1, 148-2 and 148-3. A process upset was detected at a time represented by the vertical line 406, and the control algorithm responded by closing the throttle valves 148 by more than 18% in 8 seconds. The margins of the compressors 150 abruptly fell and rebounded sharply. After 8 seconds, at a time represented by vertical line 408, the control algorithm began to re-open the throttle valves 148. The margins were disrupted, and NGL production was reduced to almost nothing.

In contrast, FIG. 4B, a process upset is detected at a time represented by vertical line 410. With the dynamic rate limiter of the disclosure implemented, the control algorithm responded by closing the throttle valves 148 at a rate limited to between 2% per minute and 6% per minute. After two minutes, at a time represented by vertical line 412, the margins of a running compressor 150, represented by curve 414-1, remains relatively constant. Curve 414-2 represents the header pressure detected in discharge stream 144, and curve 414-3 represents the closure rate for the throttle valve 148. Since the margins of the compressor 150 remained relatively constant, the NGL production correspondingly remained consistent.

In view of the foregoing structural and functional description, those skilled in the art will appreciate that portions of the embodiments may be embodied as a method, data processing system, or computer program product. Accordingly, these portions of the present embodiments may take the form of an entirely hardware embodiment, an entirely software embodiment, or an embodiment combining software and hardware, such as shown and described with respect to the computer system of FIG. 5. Furthermore, portions of the embodiments may be a computer program product on a computer-usable storage medium having computer readable program code on the medium. Any non-transitory, tangible storage media possessing structure may be utilized including, but not limited to, static and dynamic storage devices, hard disks, optical storage devices, and magnetic storage devices, but excludes any medium that is not eligible for patent protection under 35 U.S.C. § 101 (such as a propagating electrical or electromagnetic signal per se). As an example and not by way of limitation, a computer-readable storage media may include a semiconductor-based circuit or device or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, where appropriate.

Certain embodiments have also been described herein with reference to block illustrations of methods, systems, and computer program products. It will be understood that blocks of the illustrations, and combinations of blocks in the illustrations, can be implemented by computer-executable instructions. These computer-executable instructions may be provided to one or more processor of a general purpose computer, special purpose computer, or other programmable data processing apparatus (or a combination of devices and circuits) to produce a machine, such that the instructions, which execute via the processor, implement the functions specified in the block or blocks.

These computer-executable instructions may also be stored in computer-readable memory that can direct a computer or other programmable data processing apparatus to function in a particular manner, such that the instructions stored in the computer-readable memory result in an article of manufacture including instructions which implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart block or blocks.

In this regard, FIG. 5 illustrates one example of a computer system 500 that can be employed to execute one or more embodiments of the present disclosure. Computer system 500 can be implemented on one or more general purpose networked computer systems, embedded computer systems, routers, switches, server devices, client devices, various intermediate devices/nodes or standalone computer systems. Additionally, computer system 500 can be implemented on various mobile clients such as, for example, a personal digital assistant (PDA), laptop computer, pager, and the like, provided it includes sufficient processing capabilities.

Computer system 500 includes processing unit 501, system memory 502, and system bus 503 that couples various system components, including the system memory 502, to processing unit 501. Dual microprocessors and other multiprocessor architectures also can be used as processing unit 501. System bus 503 may be any of several types of bus structure including a memory bus or memory controller, a peripheral bus, and a local bus using any of a variety of bus architectures. System memory 502 includes read only memory (ROM) 504 and random access memory (RAM) 505. A basic input/output system (BIOS) 506 can reside in ROM 504 containing the basic routines that help to transfer information among elements within computer system 500.

Computer system 500 can include a hard disk drive 507, magnetic disk drive 508, e.g., to read from or write to removable disk 509, and an optical disk drive 510, e.g., for reading CD-ROM disk 511 or to read from or write to other optical media. Hard disk drive 507, magnetic disk drive 508, and optical disk drive 510 are connected to system bus 503 by a hard disk drive interface 512, a magnetic disk drive interface 513, and an optical drive interface 514, respectively. The drives and associated computer-readable media provide nonvolatile storage of data, data structures, and computer-executable instructions for computer system 500. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and RAM 505, including operating system 515, one or more application programs 516, other program modules 517, and program data 518. In some examples, the application programs 516 can include the control algorithm and load sharing modules, and the program data 518 can include the actual margins calculated in step 304, the minimum scaled margin determined in step 308 and the planned rate of closure calculated in step 310. The application programs 516 and program data 518 can include functions and methods programmed to monitor performance characteristics of the residue gas compressors 150 and other components of the flow control system 100 and provide instructions signals to limit a rate of closure for throttle valves associated with the residue gas compressors in the event a process upset is detected, such as shown and described herein.

A user may enter commands and information into computer system 500 through one or more input devices 520, such as a pointing device (e.g., a mouse, touch screen), keyboard, microphone, joystick, game pad, scanner, and the like. For instance, the user can employ input device 520 to edit or modify a suction pressure (Ps), a gas composition, a predetermined range for the scaled minimum margin, minimum. These and other input devices 520 are often connected to processing unit 502 through a corresponding port interface 522 that is coupled to the system bus, but may be connected by other interfaces, such as a parallel port, serial port, or universal serial bus (USB). One or more output devices 524 (e.g., display, a monitor, printer, projector, or other type of displaying device) is also connected to system bus 503 via interface 526, such as a video adapter.

Computer system 500 may operate in a networked environment using logical connections to one or more remote computers, such as remote computer 528. Remote computer 528 may be a workstation, computer system, router, peer device, or other common network node, and typically includes many or all the elements described relative to computer system 500. The logical connections, schematically indicated at 530, can include a local area network (LAN) and a wide area network (WAN). When used in a LAN networking environment, computer system 500 can be connected to the local network through a network interface or adapter 532. When used in a WAN networking environment, computer system 500 can include a modem, or can be connected to a communications server on the LAN. The modem, which may be internal or external, can be connected to system bus 503 via an appropriate port interface. In a networked environment, application programs 516 or program data 518 depicted relative to computer system 500, or portions thereof, may be stored in a remote memory storage device 540.

Embodiments disclosed herein include:

A. A method can include determining an operational characteristic of one or more residue gas compressors operating within a Natural Gas Liquids (NGL) extraction system and calculating a rate of closure for one or more throttle valves associated with the one or more residue gas compressors based on the operational characteristic determined. The method may further include detecting a process upset in the NGL extraction system and closing the one or more throttle valves at the calculated rate of closure in response to detecting the process.

B. A system may include a memory to store machine-readable instructions and data comprising operational data of one or more residue gas compressors operating within a Natural Gas Liquids (NGL) extraction system and one or more processors access the memory and execute the machine-readable instructions. The machine-readable instructions can cause the one or more processors to determine an operational characteristic of the one or more residue gas compressors, calculate a rate of closure for one or more throttle valves associated with the one or more residue gas compressors based on the operational characteristic determined, detect a process upset in the NGL extraction system and instruct the one or more throttle valves to close at the calculated rate of closure in response to detecting the process upset.

C. A non-transitory computer-readable storage medium can store computer executable instructions thereon. The instructions, when executed by a processor, can cause the processor to determine an operational characteristic of one or more residue gas compressors operating within a Natural Gas Liquids (NGL) extraction system, calculate a rate of closure for one or more throttle valves associated with the one or more residue gas compressors based on the operational characteristic determined, detect a process upset in the NGL extraction system and instruct the one or more throttle valves to close at the calculated rate of closure in response to detecting the process upset.

Each of embodiments A, B, and C may have one or more of the following additional elements in any combination: Element 1: wherein determining the operational characteristic includes calculating an actual margin of the one or more residue gas compressors. Element 2: wherein the one or more residue gas compressors includes a plurality of residue gas compressors coupled in parallel, and wherein determining the operational characteristic includes determining a minimum margin among the plurality of residue gas compressors. Element 3: wherein the method further includes scaling the minimum margin to arrive at a scaled minimum margin within a predetermined range. Element 4: wherein the predetermined range is from about 2% closure per minute to about 6% closure per minute. Element 5: further comprising scaling the margins of a remainder of the plurality of the residue gas compressors. Element 6: wherein the method further includes comprising iteratively updating the calculated rate of closure until the process upset is no longer detected. Element 7: wherein detecting the process upset includes detecting at least one of an operating point for one of the residue gas compressors exceeding a control line for the one of the residue gas compressors, a sudden closure of a Joule Thomson (JT) valve coupled in the NGL extraction system, a loss of flow at an inlet stream of the NGL extraction system or a fault of a turbo expander coupled in the NGL extraction system. Element 8: The method of claim 1, further comprising operating a recycle valve to direct a discharge flow from the one or more residue gas compressors to an inlet flow stream of the NGL extraction system.

Element 9: wherein the system further includes an actuator communicatively coupled to the one or more processors to receive instructions therefrom and operable to close the one or more throttle valves at the calculated rate of closure. Element 10 wherein the instructions further cause the one or more processors to calculate an actual margin of the one or more residue gas compressors. Element 11: wherein the one or more residue gas compressors includes a plurality of residue gas compressors coupled in parallel, and wherein the instructions further cause the one or more processors to determine a minimum margin among the plurality of residue gas compressors. Element 12: wherein the instructions further cause the one or more processors to scale the minimum margin to arrive at a scaled minimum margin within a predetermined range. Element 13: wherein the predetermined range is from about 2% closure per minute to about 6% closure per minute. Element 14: wherein the instructions further cause the one or more processors to iteratively update the calculated rate of closure until the process upset is no longer detected. Element 15: wherein the instructions further cause the one or more processors to detect at least one of an operating point for one of the residue gas compressors exceeding a control line for the one of the residue gas compressors, a sudden closure of a Joule Thomson (JT) valve coupled in the NGL extraction system, a loss of flow at an inlet stream of the NGL extraction system or a fault of a turbo expander coupled in the NGL extraction system.

By way of non-limiting example, exemplary combinations applicable to A, B, and C include: Element 1 with Element 2; Element 2 with Element 3; Element 3 with Element 4; Element 3 with Element 5; Element 10 with Element 11; Element 11 with Element 12; and Element 12 with Element 13.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method, comprising:

determining an operational characteristic of one or more residue gas compressors operating within a Natural Gas Liquids (NGL) extraction system;

calculating a rate of closure for one or more throttle valves associated with the one or more residue gas compressors based on the operational characteristic determined;

detecting a process upset in the NGL extraction system; and closing the one or more throttle valves at the calculated rate of closure in response to detecting the process upset.

2. The method of claim 1, wherein determining the operational characteristic includes calculating an actual margin of the one or more residue gas compressors.

3. The method of claim 2, wherein the one or more residue gas compressors includes a plurality of residue gas compressors coupled in parallel, and wherein determining the operational characteristic includes determining a minimum margin among the plurality of residue gas compressors.

4. The method of claim 3, further comprising scaling the minimum margin to arrive at a scaled minimum margin within a predetermined range.

5. The method of claim 4, wherein the predetermined range is from about 2% closure per minute to about 6% closure per minute.

6. The method of claim 4, further comprising scaling the margins of a remainder of the plurality of the residue gas compressors.

7. The method of claim 1, further comprising iteratively updating the calculated rate of closure until the process upset is no longer detected.

8. The method of claim 1, wherein detecting the process upset includes detecting at least one of an operating point for one of the residue gas compressors exceeding a control line for the one of the residue gas compressors, a sudden closure of a Joule Thomson (JT) valve coupled in the NGL extraction system, a loss of flow at an inlet stream of the NGL extraction system or a fault of a turbo expander coupled in the NGL extraction system.

9. The method of claim 1, further comprising operating a recycle valve to direct a discharge flow from the one or more residue gas compressors to an inlet flow stream of the NGL extraction system.

10. The method of claim 1, wherein calculating the rate of closure is performed with a processor implementing a load sharing application of a flow control algorithm.

11. A system, comprising:

memory to store non-transitory machine-readable instructions and data comprising operational data of one or more residue gas compressors operating within a Natural Gas Liquids (NGL) extraction system; and one or more processors to access the memory and execute the non-transitory machine-readable instructions, the non-transitory machine-readable instructions causing the one or more processors to:

determine an operational characteristic of the one or more residue gas compressors;

calculate a rate of closure for one or more throttle valves associated with the one or more residue gas compressors based on the operational characteristic determined;

detect a process upset in the NGL extraction system; and instruct the one or more throttle valves to close at the calculated rate of closure in response to detecting the process upset.

12. The system of claim 11, further comprising an actuator communicatively coupled to the one or more processors to receive instructions therefrom and operable to close the one or more throttle valves at the calculated rate of closure.

13. The system of claim 11, wherein the non-transitory machine-readable instructions further cause the one or more processors to calculate an actual margin of the one or more residue gas compressors.

14. The system of claim 13, wherein the one or more residue gas compressors includes a plurality of residue gas compressors coupled in parallel, and wherein the non-transitory machine-readable instructions further cause the one or more processors to determine a minimum margin among the plurality of residue gas compressors.

15. The system of claim 14, wherein the non-transitory machine-readable instructions further cause the one or more processors to scale the minimum margin to arrive at a scaled minimum margin within a predetermined range.

16. The system of claim 15, wherein the predetermined range is from about 2% closure per minute to about 6% closure per minute.

17. The system of claim 11, wherein the non-transitory machine-readable instructions further cause the one or more processors to iteratively update the calculated rate of closure until the process upset is no longer detected.

18. The system of claim 11, wherein the non-transitory machine-readable instructions further cause the one or more processors to detect at least one of an operating point for one of the residue gas compressors exceeding a control line for the one of the residue gas compressors, a sudden closure of a Joule Thomson (JT) valve coupled in the NGL extraction system, a loss of flow at an inlet stream of the NGL extraction system or a fault of a turbo expander coupled in the NGL extraction system.

19. The system of claim 11, wherein the non-transitory machine-readable instructions further cause the one or more processors to instruct a recycle valve to direct a discharge flow from the one or more residue gas compressors to an inlet flow stream of the NGL extraction system.

20. A non-transitory computer-readable storage medium storing computer executable instructions thereon, the instructions, when executed by a processor, cause the processor to:

determine an operational characteristic of one or more residue gas compressors operating within a Natural Gas Liquids (NGL) extraction system;

calculate a rate of closure for one or more throttle valves associated with the one or more residue gas compressors based on the operational characteristic determined;

detect a process upset in the NGL extraction system; and instruct the one or more throttle valves to close at the calculated rate of closure in response to detecting the process upset.

* * * * *